United States Patent [19]

Tash

[11] Patent Number: 4,672,988

[45] Date of Patent: Jun. 16, 1987

[54] CONDUIT FLUSHING DEVICE

[76] Inventor: George Tash, 19438 Business Center Dr., Northridge, Calif. 91324

[21] Appl. No.: 725,900

[22] Filed: Apr. 22, 1985

[51] Int. Cl.[4] ..... B08B 9/02

[52] U.S. Cl. ..... 134/167 C; 134/172; 137/240; 137/494; 239/533.1; 239/DIG. 13; 251/61.1

[58] Field of Search ..... 134/166 C, 167 C, 169 C, 134/172; 239/533.1, DIG. 13; 251/61.1; 137/238, 240, 494; 138/93

[56] References Cited

U.S. PATENT DOCUMENTS

| | | | |
|---|---|---|---|
| 998,155 | 7/1911 | Bowser | 137/494 |
| 1,173,518 | 2/1916 | Hoxie | 137/494 |
| 1,839,979 | 1/1932 | Barrere | 134/167 C X |
| 1,849,269 | 3/1932 | Petersen | 134/167 C |
| 3,595,255 | 7/1971 | Mulinex | 134/167 C |
| 3,802,449 | 4/1974 | Mulinex | 134/166 C |
| 4,475,255 | 10/1985 | Tash | 134/167 C |
| 4,512,514 | 4/1985 | Elcott | 239/533.1 |

*Primary Examiner*—Harvey C. Hornsby
*Assistant Examiner*—Frankie L. Stinson
*Attorney, Agent, or Firm*—John J. Posta, Jr.

[57] ABSTRACT

A conduit flushing device comprising an elastomeric tubular body having one end thereof to be connected to a suitable source of water under pressure with the opposite end of the tubular body being connected to a valve. The valve is normally closed by an integral portion of the tubular body being in watertight contact with an elongated sealing member of the valve. Supplying of water within the tubular body causes the body to expand spacing the seat assembly from the sealing member permitting flow of water from the internal chamber of the tubular body and through the valve.

4 Claims, 4 Drawing Figures

CONDUIT FLUSHING DEVICE

BACKGROUND OF THE INVENTION

Waste water pipes within homes and buildings are exceedingly common. Such waste water pipes are used in conjunction with bathtubs, showers, kitchen sinks and washing machines.

It is common that occasionally a waste water pipe will become clogged with a solid or semi-solid foreign material which causes stoppage of normal flow of water through the pipe. In order to effect normal flow through the pipe, it is necessary to clear the pipe of the stoppage.

In the past there has been available a convenient method of removing such stoppages, and that is of utilizing the pressurized water system of the house or building itself to be directed against the clog within the pipe to effect removing of such. One such device is defined within U.S. Pat. No. 3,792,708, issued Feb. 19, 1974, entitled, "Fluid Flow Director". In order for such a device to be effective it is necessary to close the opening end of the pipe into which the high pressure water is directed in order to prevent the water from taking the path of least resistance and exiting from the same end it enters. This has been found to be achievable by having the water pressure itself expand an elastomeric body into tight contact with the interior wall of the pipe which prevents this backflow of water. Hydraulic pressure is then built up between the device and the clog which hopefully will force the clog along the pipe until the pipe is cleared.

From a manufacturing point of view, in order to minimize expense it is desirable to construct such a device with a minimum of parts and a minimum amount of assembly. The less expensive that a part can be manufactured, the less expensive would be the selling price, therefore, making the part more readily available to a greater number of people.

SUMMARY OF THE INVENTION

The present invention takes the form of a flushing device consisting of an open ended elastomeric tube. The back end of the tube is connected to a hose connector which is in turn adapted to be connected to a conventional garden hose in order to supply a stream of pressurized water to within the interior of the tubular flushing device. The outer or free end of the tubular flushing device has mounted therein a valve. The valve has an elongated cylindrical shaped protrusion which is to be tightly engaged with an annular elastomeric sealing seat when the body of the flushing device is in an unexpanded state thereby preventing flow of water through the flushing device. The annular elastomeric sealing seat is integrally formed with the body of the flushing device. There is a natural tendency for the flushing device to contract to the closed position even when it is expanded and flow of water is being passed through the flushing device. This natural contraction results in emitted pulses of water from the flushing device. These pulses create blows, similar to hammer blows tending to dislodge the clog from within the pipe.

DETAILED DESCRIPTION OF THE SHOWN EMBODIMENT

Figure 1:
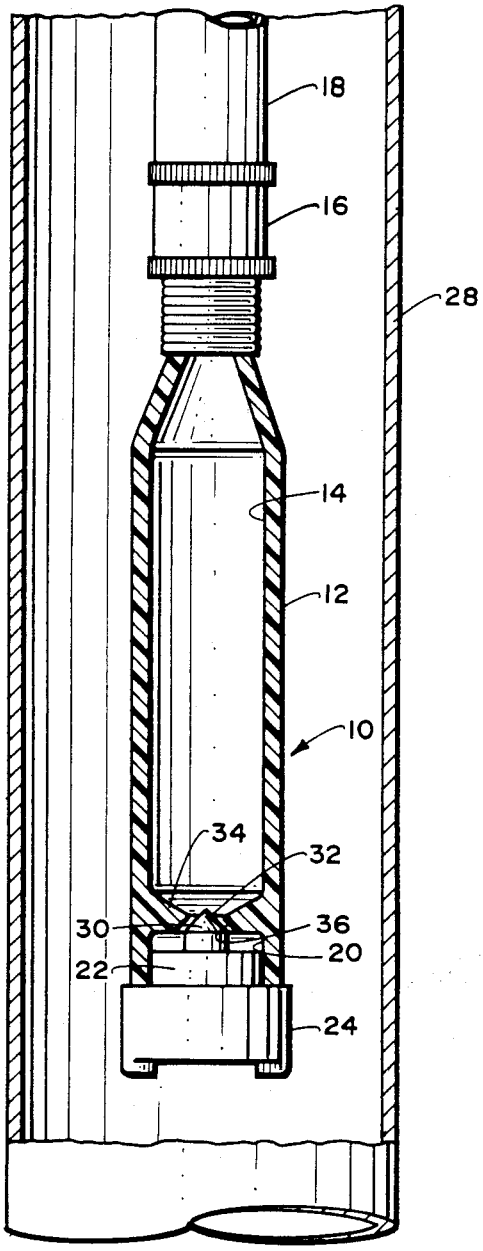
FIG. 1 is a longitudinal cross-sectional view of the conduit flushing device of this invention showing the flushing device in the unexpanded state and located within a conduit.

Referring now to the drawing, there is shown a conduit flushing device 10 which has an elastomeric tubular body 12. Preferably, the tubular body 12 will be constructed of latex. However, it is considered to be within the scope of this invention that any other expandable material such as a plastic could be utilized without departing from the scope of this invention.

The tubular body 12 is hollow, forming an internal chamber 14. The internal chamber 14 also is open ended. Attached to the body 12 at the aft end of the chamber 14 is a hose connector 16. The hose connector 16 is deemed to be conventional and is secured in such a manner that the hose connector can be connected in a liquid tight manner with a conventional garden hose 18. There is a screw threading connection between the garden hose 18 and the connector 16. It is to be also understood that pressurized water is to be supplied from the hose 18 to within the internal chamber 14.

The fore or outer end of the tubular body 12, as previously described, is open defining a valve receiving chamber 20. Within the valve receiving chamber 20 there is to be located a valve housing 22. The valve housing will normally be constructed of a rigid material such as metal, plastic or the like.

The valve housing 22 is securely held in position by means of a ferrule 24. The ferrule 24 is mechanically swedged about the valve housing 22 with the tubular body 12 located therebetween.

The valve housing 22 also includes a plurality of openings 26. The openings 26 establish a connecting path between valve receiving chamber 20 and the ambient which can be referred to as downstream the flushing device 10 in regard to the pipe or conduit 28 within which the flushing device 10 is located.

The valve housing 22 has a sealing member 30 which is basically cylindrical in transverse cross-section and extends in a protruding manner from the valve housing 22 toward the hose connector 16. The sealing member 30 includes a cone-shaped annular surface 32.

Figure 2:
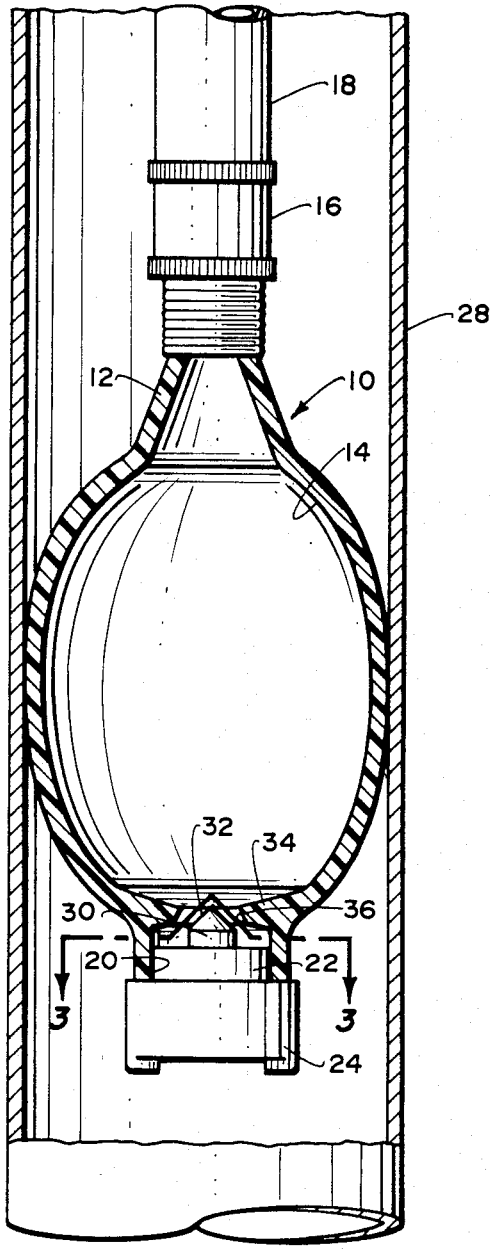
FIG. 2 is a view similar to FIG. 1 showing the conduit flushing device in the expanded state in tight contact with the internal wall of the conduit.
Figure 3:
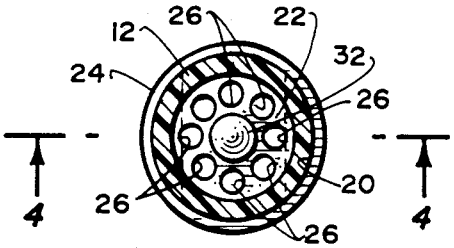
FIG. 3 is an inside end view of the valve utilized in conjunction with the conduit flushing device of the present invention.
Figure 4:
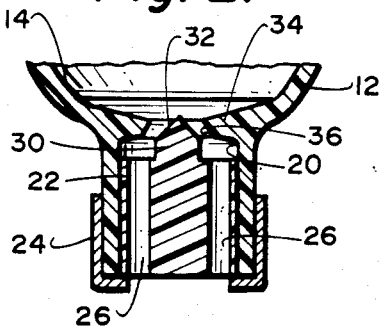
FIG. 4 is a cross-sectional view through the valve taken along line 4—4 of FIG. 3 showing the valve as mounted within the conduit flushing device when such is in the expanded state.

Integrally formed with respect to the body 12 and extending inwardly within the interior chamber 14 is a seat assembly 34. Seat assembly 34 is also annular and defines a central opening 36. With the body 12 in the unexpanded position as shown in FIG. 1, the protruding sealing member 30 extends within the opening 36 with the wall of the opening 36 being in tight engagement with the annular cone-shaped surface 32. In this particular position, water flow is prevented from exiting the internal chamber 14 through the opening 26. However, upon sufficient water pressure being built up within the internal chamber 14 and such expanding to the position shown in FIG. 2, there is space occurring between the sealing member 30 and the seat assembly 34 which then permits water flow from the internal chamber 14 within the valve chamber 20 and hence through the openings 22 and into the ambient.

It is to be noted that water flow is only conducted through the opening 26 only when the body 12 is completely or totally expanded. Partial expansion is not sufficient. Also, there is a natural tendency for the body 12 to contract to the unexpanded state which means that as water is discharged through the openings 26, that there will be a momentary decrease in pressure within the chamber 14 until the chamber 14 completely fills with water again by the garden hose 18. This momentary release in pressure causes seat assembly 34 to momentarily tightly connect with the annular surface 32 preventing conducting of water from the chamber 14 and into the valve chamber 20. Water pressure, of course, quickly builds within the chamber 14 which results in a snap action type of expansion of seat assembly 34 again to a spaced position which then causes a quantity of water to be discharged through the openings 26. This discharge of water will again cause the seat assembly 34 to contract in contact with the annular surface 32. This procedure continually repeats itself resulting in a series of pulses, or jets of water being discharged from the flushing device 10. These pulses or jets resemble a series of hammer blows jarred to impinge against the foreign material blocking the pipe 28 causing such to break loose and flow through the pipe 28 thereby clearing same.

What is claimed is:

1. A conduit flushing device comprising:

(a) an expandable, tubular body having inlet and outlet portions, along with a mid-portion defining a chamber therein, (b) said inlet portion adapted to be connected to a source of fluid under pressure, (c) a valve member having a lower portion, said lower portion being secured to the outlet portion of said tubular body, (d) said valve member being secured to said tubular body solely at said lower portion, (e) said lower portion of said valve member having at least one longitudinal opening extending therethrough through which fluid entering said chamber can pass out of said tubular body.

(f) said valve member having an upwardly directed extension therein, which extension terminates in a conical portion, (g) said outlet portion having an inwardly directed, flexible seating projection adapted to contact and mate with the conical portion of said extension when the tubular member is in an at rest position to provide a positive horizontal and vertically directed sealing force between the entire conical portion and said projection, to thereby prevent passage of fluid from said chamber past said projection, (h) said outlet portion being sufficiently flexible to allow unfettered movement of said flexible seating projection out of contact with said extension when said chamber is sufficiently increased in size so as to allow the passage of fluid from said chamber, past said extension and through said opening.

(i) wherein the outside diameter of said conical portion is less than the outside diameter of said lower portion of said valve member, and wherein said longitudinal opening lies outside the periphery of said conical portion to enable substantially free flow of said fluid past said conical portion, through said opening and out of said outlet portion.

2. The flushing device of claim 1 wherein said projection is flexible, is rigidly secured to the outlet portion; and has a seating portion which is complimentary to said conical portion on said extension.

3. The flushing device of claim 2 wherein said projection is in the form of a radially extending disc having an opening in the center thereof adapted to receive therein said conical portion of said extension, and having its outer circumference integrally connected to the inner surface of said outlet portion.

4. The flushing device of claim 3 wherein a plurality of longitudinal openings are provided in said valve member.

* * * * *